US006569266B2

(12) United States Patent
Inoue et al.

(10) Patent No.: US 6,569,266 B2
(45) Date of Patent: May 27, 2003

(54) NITRIDED STEEL SLIDING MEMBER HAVING IMPROVED WEAR RESISTANCE AND FATIGUE STRENGTH

(75) Inventors: Shigeo Inoue, Niigata (JP); Toru Onuki, Niigata (JP)

(73) Assignee: Kabushiki Kaisha Riken, Tokyo (JP)

( * ) Notice: Subject to any disclaimer, the term of this patent is extended or adjusted under 35 U.S.C. 154(b) by 0 days.

(21) Appl. No.: 09/840,300

(22) Filed: Apr. 24, 2001

(65) Prior Publication Data

US 2001/0054456 A1 Dec. 27, 2001

(30) Foreign Application Priority Data

Apr. 25, 2000 (JP) ..... 2000-124457

(51) Int. Cl.[7] ..... C22C 38/22; C22C 38/24
(52) U.S. Cl. ..... 148/318
(58) Field of Search ..... 148/318, 325, 148/334; 420/111, 69

(56) References Cited

U.S. PATENT DOCUMENTS

| | | | | | |
|---|---|---|---|---|---|
| 4,618,317 | A | | 10/1986 | Matsuzaki | 418/63 |
| 5,944,920 | A | * | 8/1999 | Fukushima | 148/333 |
| 6,024,916 | A | * | 2/2000 | Urita et al. | 420/110 |

FOREIGN PATENT DOCUMENTS

| | | | | |
|---|---|---|---|---|
| EP | 0 799 902 A1 | | 10/1997 | |
| EP | 1 072 691 A2 | | 1/2001 | |
| JP | 59-157261 A | | 9/1984 | |
| JP | 60-155647 A | | 8/1985 | |
| JP | 61-174362 | * | 8/1986 | C22C/38/24 |
| JP | 5-179401 | * | 7/1993 | C22C/38/24 |

* cited by examiner

*Primary Examiner*—Deborah Yee
(74) *Attorney, Agent, or Firm*—Kubovcik & Kubovcik

(57) ABSTRACT

The steel for nitriding consists of 0.5 to 1.0% of C, 1.0% or less of Si, 0.3 to 1.0% of Mn, 5.0 to 12.0% of Cr, 0.5 to 2.0% of Mo, 0.1 to 0.3% of V, the balance being Fe and exhibits improved wear-resistance and fatigue-strength.

4 Claims, 9 Drawing Sheets

SURFACE X400

CROSS SECTION X400

INVENTION PRODUCT A

MICRO PHOTOGRAPH OF THE FRACTURE SURFACE OF INVENTION PRODUCT A

SURFACE X400

CROSS SECTION X400

INVENTION PRODUCT A

SURFACE

CROSS SECTION X400

INVENTION PRODUCT B

SURFACE

CROSS SECTION X400

COMPARATIVE PRODUCT

SURFACE X400

DIFFUSION LAYER

CROSS SECTION X400

COMPARATIVE PRODUCT

PRIOR ART

NITRIDED STEEL SLIDING MEMBER HAVING IMPROVED WEAR RESISTANCE AND FATIGUE STRENGTH

BACKGROUND OF INVENTION

1. Field of Invention

The present invention relates to steel for nitriding and a sliding member made of the steel with the nitriding. More particularly, the present invention relates to steel where nitriding or soft-nitriding is conducted on the surface thereof. The steel with the nitriding or soft-nitriding exhibits high wear-resistance and fatigue-strength and is appropriate for the sliding member.

2. Description of Related Art

There are a number of parts which are required to satisfy sliding property and fatigue resistance property simultaneously, such as a spring, a piston ring and a gear. The scuff resistance and the wear-resistance properties are collectively referred as the sliding property. Generally speaking, the sliding property and the fatigue resistance property are contradictory to each other as follows. An increase in hardness results in improvement of the sliding property but incurs embrittlement and strength reduction of the material. Since fatigue strength is usually recognized to be a half of the tensile strength, the strength reduction readily result in reduction of the fatigue strength. The nitriding treatment is used at present to solve the contradiction as described above. That is, a product made of steel for nitriding, is subjected to nitriding on the sliding surface thereof Surface hardness of the steel with the nitriding is greatly enhanced as compared with that of the inside of the steel. As a result, the sliding property such as wear resistance and scuff resistance properties is greatly improved.

In addition to the hardness increase, large residual compressive stress generates on the surface of the steel with the nitriding. The fatigue strength is, therefore, greatly improved as compared with that of the steel without the nitriding. When the steel surface with the nitriding is further subjected to shot-peening or carburization, large further compressive stress is superimposed so that the parts having higher fatigue strength are provided.

As the steel for nitriding, it is known heretofore to use a martensitic 13Cr stainless steel as well as low-alloyed steel with the addition of Al and Cr.

Heretofore, almost no discussions or consideration has been made as to nitriding structure to enhance fatigue strength to a required level. In other words, if the fatigue strength by the nitriding is unsatisfied, the steel with nitriding is ordinarily subjected to post-nitriding treatment such as shot-peening or carburization. The post-nitriding treatment increases, however, processing steps and cost.

SUMMARY OF INVENTION

It is, therefore, an object of the present invention to provide such a steel for nitriding that the required level of the fatigue strength can be attained by nitriding without post-nitriding treatment such as shot-peening and carburization.

It is also an object of the present invention to provide a sliding-member having satisfactory fatigue strength without post-nitriding treatment such as shot-peening and carburization.

In accordance with the objects of the present invention, there is provided a steel for nitriding, which consists of from 0.5 to 1.0% of C, 1.0% or less of Si, from 0.3 to 1.0% of Mn, from 5.0 to 12.0% of Cr, from 0.5 to 2.0% of Mo, from 0.1 to 0.3% of V, the balance being Fe and unavoidable impurities.

There is also provided a sliding member made of the steel with nitriding or soft-nitriding mentioned above.

According to an embodiment of the sliding member of the present invention, the nitriding layer comprises crystalized grains, (iron) compound layers precipitating along the boundaries of the crystal grains, and precipitates consisting essentially of carbonitrides dispersed within the crystal grains and having less than 10 $\mu$m in size, and, further, the area percentage of the precipitates from 1 to 10 $\mu$m in size is 5% or less.

The fracture toughness of the nitriding layer of the steel according to the present invention is high. The sliding member with the nitriding has thus high fatigue resistance even if without post-nitriding treatment. The present invention is hereinafter described with reference to the composition.

DESCRIPTION OF PREFERRED EMBODIMENTS

A part of the alloyed Cr substitutes for Fe of the iron lattices, and Fe and Cr form a substitutional solid solution. The solute Cr of the substitutional solid solution promotes the nitriding. The other part of Cr reacts with C and forms chromium carbide in the steel. Fine carbo-nitrides are formed in the nitriding layer after the nitriding or soft-nitriding. As a result, the matrix in the nitriding layer is moderately hardened by the fine carbo-nitrides. The matrix in the nitriding layer provides resistance against propagation of cracks generated inside the material, as described more in detail hereinbelow. This resistance against crack propagation and the fatigue strength attained by the present invention are higher than that of the steel member having less than 5% of Cr, or that of the steel member without nitriding. When the Cr content is 12.0% or more, since almost all of the Cr carbides is converted to carbo-nitrides after nitriding, coarse carbo-nitrides or a coalescent structure of fine carbo-nitrides is easily formed. As a result, the fatigue strength is lowered. The Cr content is, therefore, 12% or less. A preferable Cr content is from 7 to 11%. In the surface vicinity of the steel (supposed nitriding layer), where the nitriding layer is to be formed, the following structure is preferable. That is, the size of the Cr carbide in the surface layer (supposed nitriding layer) is 10 $\mu$m or less, and the area ratio of the Cr carbide from 1 to 10 $\mu$m in size is 5% or less. The steel for nitriding having such fine carbide-structure can be produced for example by means of increasing the cooling speed in casting.

A part of C is dissolved in the matrix of the steel for nitriding and raises the hardness by the interstitial solution hardening, while the other part of C reacts with Cr and other carbide-forming elements and forms carbides. The wear resistance is thus enhanced. The C content must therefore be 0.5% or more. On the other hand when the C content is 1.0% or more, carbides prominently tend to so coarsen as to impede the nitriding. A more significant fact is that the cold workability is extremely impaired at a C content of 1.0% or more. The C content is not less than 0.5% and not more than 1.0%. A preferable C content is from 0.7 to 0.8%.

Si is added as a deoxidizing agent and is dissolved in the Fe matrix, too. This Si solute improves the resistance against thermal setting. Si may, therefore, be contained in some degree. However, when the Si content is more than 1.0%, the cold workability is impaired due to embrittlement. The Si content is therefore 1.0% or less.

Mn is also added as a deoxidizing agent as is Si. Mn content of 0.3% or more is necessary for the deoxidation. When the Mn content is 1.0% or more, oxidation resistance as well as the hot workability and cold workability are impaired. The Mn content is, therefore, not less than 0.3% and not more than 1.0%.

Mo in an amount of 0.5% or more is necessary for suppressing the temper softening during the nitriding. Mo forms the carbides in small size and enhances the hardness. Mo is, thus, effective for enhancing the wear resistance. However, when Mo, which is a strong carbide-former, is added in an amount of 2.0% or more, the coarse carbides are formed. As a result, a structure having high fatigue resistance cannot be obtained. The Mo content is, therefore, not less than 0.5% and not more than 2.0%.

A trace amount of V greatly enhances nitriding velocity and hardness of the nitriding layer. This effect is not realized when the V content is less than 0.1%. On the other hand, when the V content is 0.3% or more, vanadium carbides are formed in the grain boundaries, thereby lessening the toughness. The V content is, therefore not less than 0.1% and not more than 0.3%.

A sliding member according to the present invention comprises a nitriding layer having from 5 to 200 $\mu$m of thickness, on at least the outer peripheral sliding surface of the steel. The precipitates mainly consists of carbo-nitrides and is dispersed in the crystal grains of the matrix of the nitriding layer. The matrix phases is martensite, in which solute Cr is contained, and the like. Others are carbides and the like. In the present invention, the precipitates are controlled to 10 $\mu$m or less in size, so as to enhance the sliding property of the nitriding layer itself. In addition, the area ratio of the precipitates not less than 1 $\mu$m and not more than 10 $\mu$m in size is controlled to less than 5%, so as to suppress mutual coalescence of the carbo-nitrides.

Relatively large iron compounds precipitates along the grain boundaries. When the Cr carbides exist in the microstructure is coverted to Cr carbonitrides during the nitriding. A portion of the carbon of the carbides becomes excessive. Such excessive carbon is expelled from the carbides toward the grain boundaries and reacts with Fe and N at the grain boundaries. The resultant compound is a very hard compound. The grain-boundary compound is three-dimensionally continuous because of the reasons described above. For a crack originated at the non-metallic compound to propagate through the nitriding layer, it must cross through the grain-boundary compound. In other words, this compound is effective for impeding the propagation of cracks, since this compound precipitates along the grain boundaries of the nitriding layer. Specifically, the uniformly precipitated compound indicates a network structure. As a result, the fatigue resistance is furthermore enhanced.

The nitriding methods, which can be applied to the steel according to the present invention, are varied, such as gas-nitriding, soft-nitriding and salt-bath nitriding.

Figure 1:
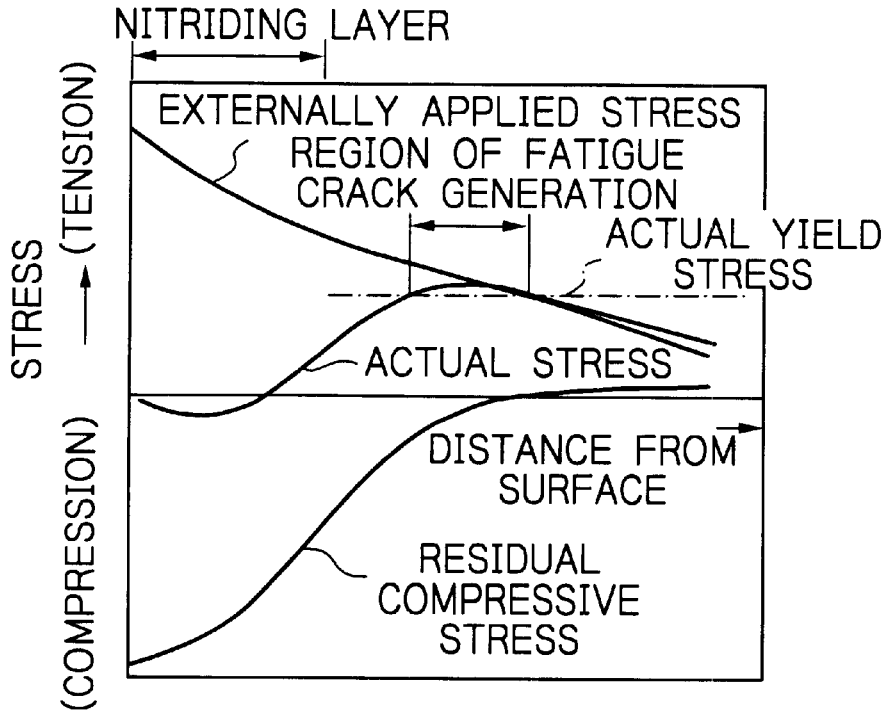
FIG. 1 is a graph illustrating the distribution of stress in the vicinity of a surface portion of the nitriding layer.
Figure 2:
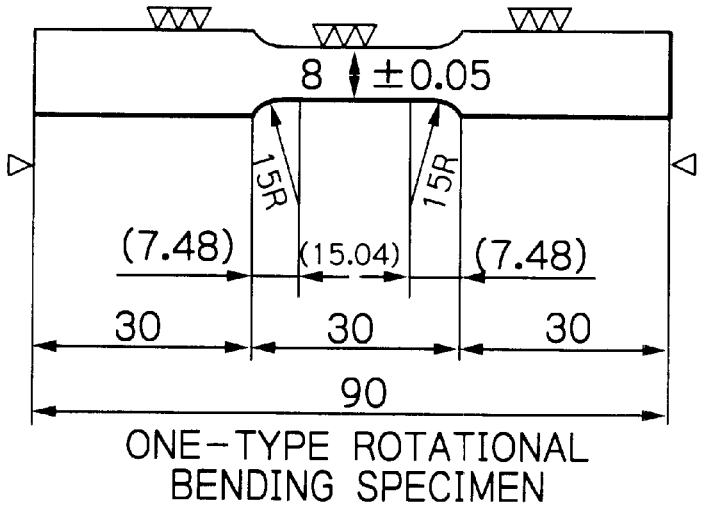
Fig. 2 PRIOR ART
FIG. 2 shows the Ono-type rotational bending specimen.

It is now described how the fatigue fracture becomes unlikely to occur in the steel with nitriding according to the present invention with reference to FIG. 1. Residual compressive stress is generated on the surface of nitriding layer. When external stress is applied to the steel with the nitriding, the external stress is greatest on the surface and attenuates in the interior with the distance from the surface. The actual stress in the steel is, therefore, vector summation of the residual compressive stress and the external tensile stress. The highest stress generates not on the surface but in an appreciably inner portion of a material (steel). This means that the fatigue fracture starts not on the surface but in an appreciably inner portion of a material (steel). It is generally known that the fracture originates from a non-metallic inclusion.

When a crack originates from non-metallic inclusion in the appreciably inner portion of a material (steel), the crack propagates in two directions. Namely, the crack propagates toward the interior and the surface. The inner portion of the steel is not subjected to nitriding and has, hence, satisfactorily high fracture toughness. On the other hand, the nitriding surface portion is brittle and has very low fracture toughness. The crack therefore easily propagates in the nitriding layer. The propagating energy of a crack is, therefore, determined by the fracture-toughness value of the nitriding layer itself When a crack reaches the surface of the steel with the nitriding, the compressive stress of the nitriding layer is no more effective for preventing propagation of the crack. Since such crack has been elongated across the nitriding layer, it propagates toward the interior due to the notch effect. The subsequent propagating speed of the crack increases in an accelerating manner, thereby finally leading to fatigue fracture.

As is described with reference to FIG. 1, in order to develop steel for nitriding having improved fatigue strength, the nitriding structure of steel should suppress the propagation of a crack generated in the inner portion of the steel. The Cr and C contents of steel adjusted as hereinabove are crucial for providing the nitriding structure.

The present invention is hereinafter described with reference to the examples.

The martensitic stainless steels having the composition shown in Table 1 were melted in an electric furnace and then cast into ingots. The ingots were rough-rolled into billets. The billets were reduced by hot rolling to round bars having 15 mm of diameter. The round bars were shaped into Ono-type rotational bending specimens as shown in FIG. 1.

Comparative Products A and B have lower and higher Cr content, respectively, than that of the invention.

TABLE 1

Chemical Composition of Samples

| | C | Si | Mn | Cr | Mo | V | Fe |
|---|---|---|---|---|---|---|---|
| Invention Products A | 0.79 | 0.32 | 0.42 | 8.04 | 0.79 | 0.15 | bal |
| Invention Products B | 0.78 | 0.32 | 0.44 | 9.93 | 0.76 | 0.15 | bal |
| Comparative Products A | 0.78 | 0.32 | 0.77 | 4.80 | 0.99 | 0.16 | bal |
| Comparative Products b | 0.82 | 0.42 | 0.42 | 17.4 | 0.12 | 0.10 | bal |

Subsequently, the gas nitriding in the narrow sense was carried out under the conditions of 570° C. for 360 minutes. After the nitriding, the surface compound layer (so called white layer) formed on the surface of the samples was removed by Emery paper. The surface finish was then carried out by successively using #180, #320, #360 and #1200 Emery papers. The so-prepared fatigue specimens were subjected to the fatigue test using the Ono-type rotational bending tester. The fatigue limit (MPa) was defined by a stress, which does not lead to fatigue fracture at $10^7$ cycles. The fatigue limits of the present invention and comparative Products are shown in Table 2. Furthermore, the location of the fracture origin and the area ratio of the carbo-nitride precipitates of 1 $\mu$m or more in size are shown in Table 2.

TABLE 2

Fatigue Limits of Present Invention and Comparative Products

| | Fatigue Limit (MPa) | Location of Fracture Origin | Area Ratio (%) of Carbo-Nitride 1–5 $\mu$m |
|---|---|---|---|
| Invention Product A | 842 | Inner Portion | 2.4 |
| Invention Product B | 853 | Inner Portion | 3.5 |
| Comparative Product A | 742 | Inner Portion | 2.5 |
| Comparative Product B | 617 | Inner Portion | 11.9 |

Although the invention products are different from the comparative only in the Cr content, the fatigue limit of the former is higher than the latter by approximately 100 MPa to 230 MPa. This is due to the microstructural change of the nitriding layer.

Figure 3:
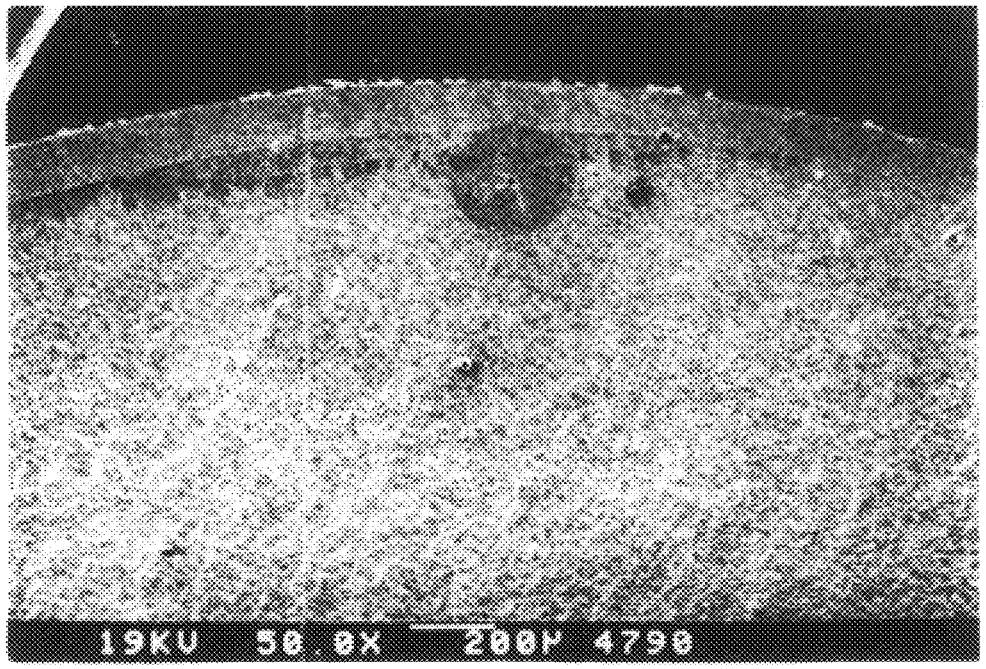
FIG. 3 is a microphotograph (magnification of 400 times) of the fracture surface of the Invention Product A showing a fracture origin located inside the material.

Referring to FIG. 3, the SEM photograph of the fractured surface of Invention Material A is shown. The crack originates from the non-metallic inclusion, which is located somewhat inside from the boundary of the nitriding layer (i.e., the diffusion layer of nitrogen). This fact would verify the fracture model illustrated in FIG. 1.

Figure 4:
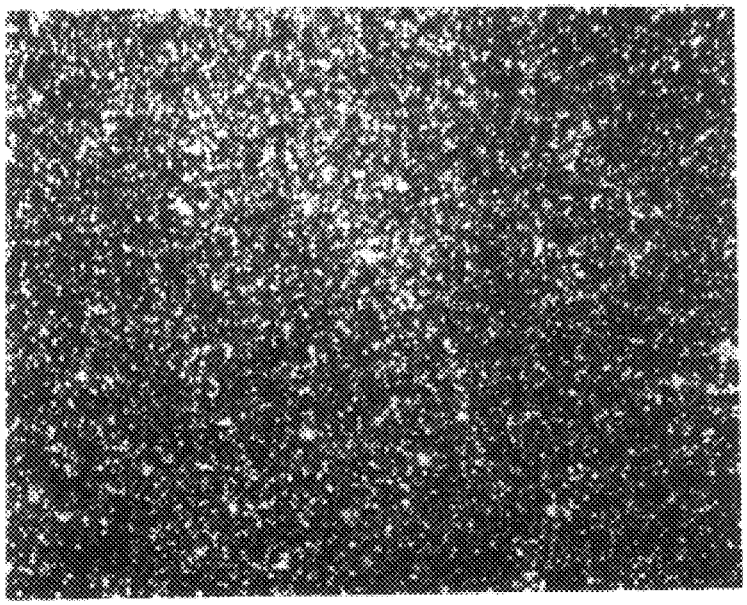
FIG. 4 is a microphotograph (magnification of 400 times) of the surface and the cross section of the nitriding layer of the Invention Product A.
Figure 4:
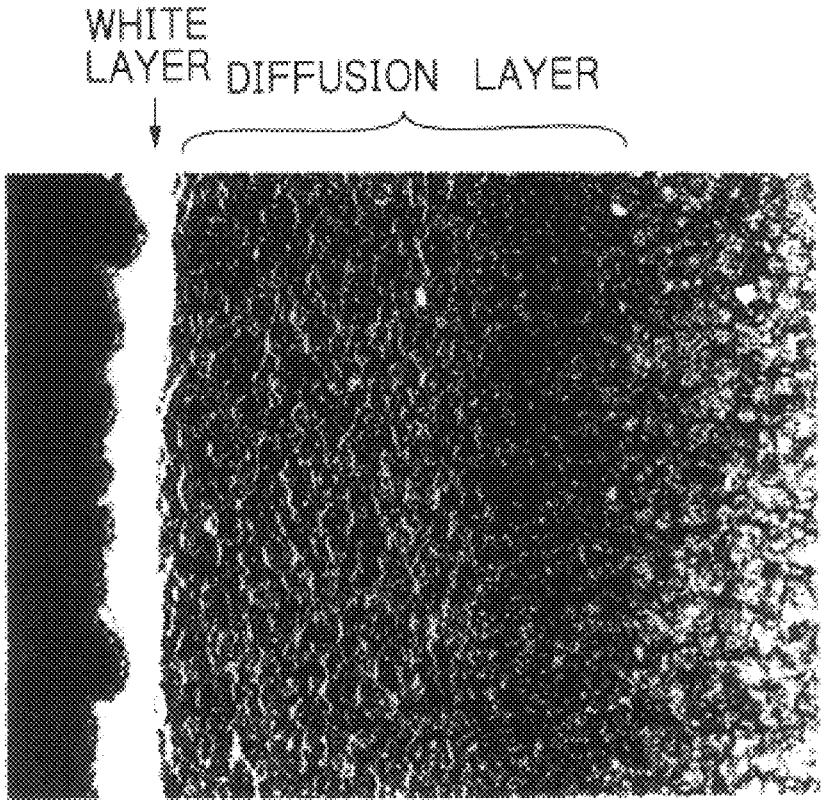
Figure 5:
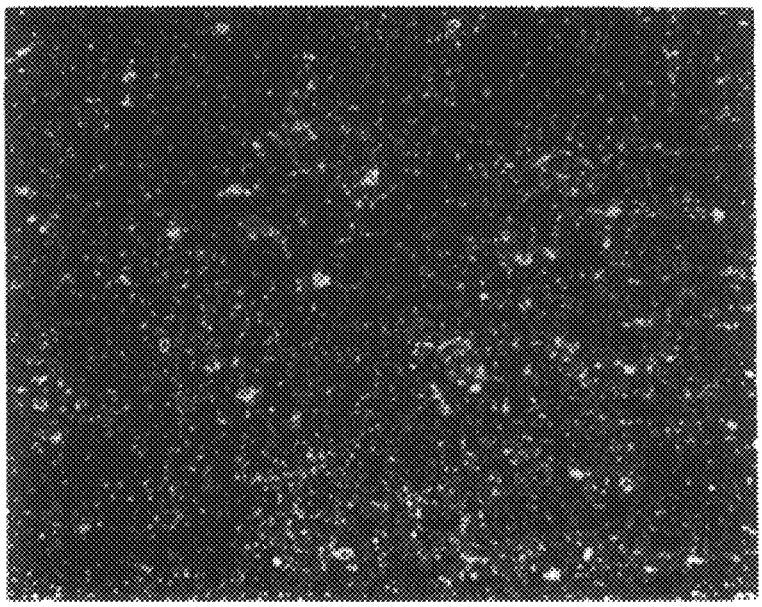
FIG. 5 is a microphotograph (magnification of 400 times) of the surface and the cross section of the nitriding layer of the Invention Product B.
Figure 5:
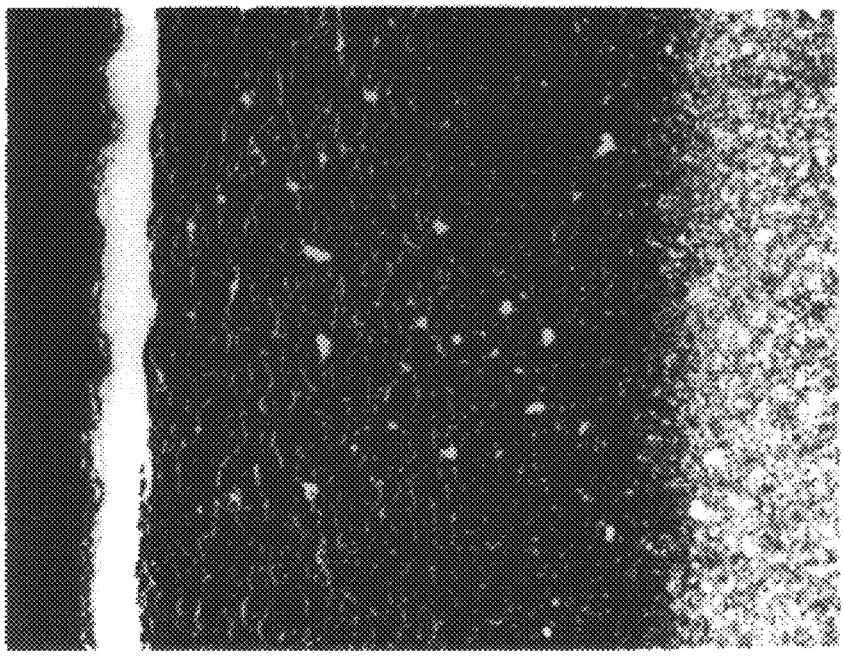
Figure 6:
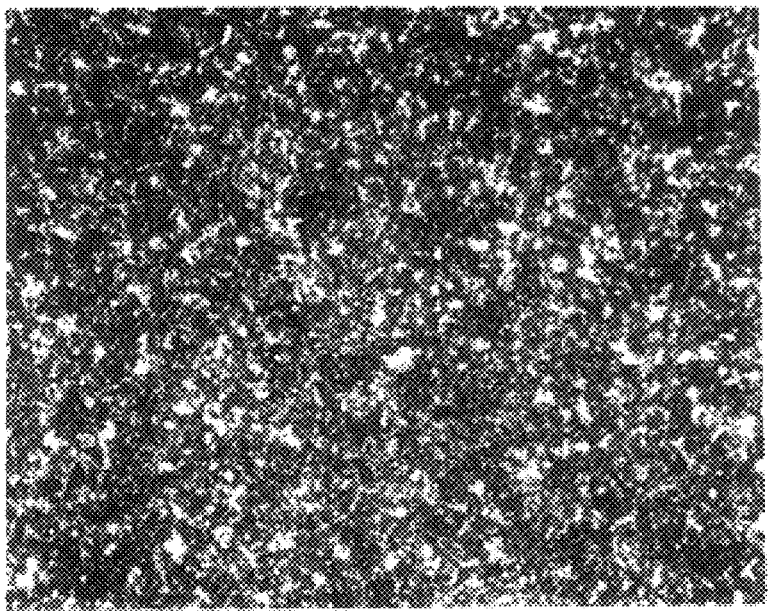
FIG. 6 is a microphotograph (magnification of 400 times) of the surface and the cross section of the nitriding layer of the Comparative Product A.
Figure 6:
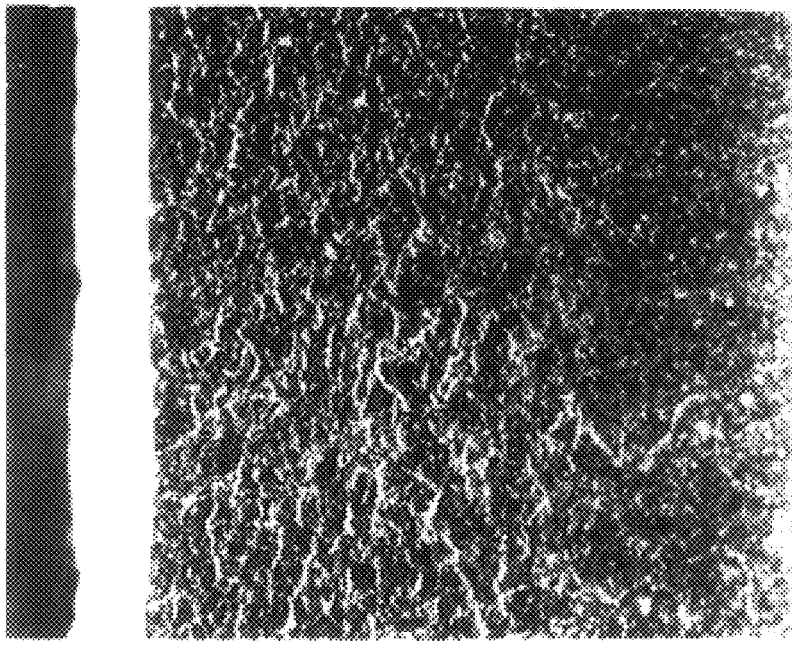
Figure 7:
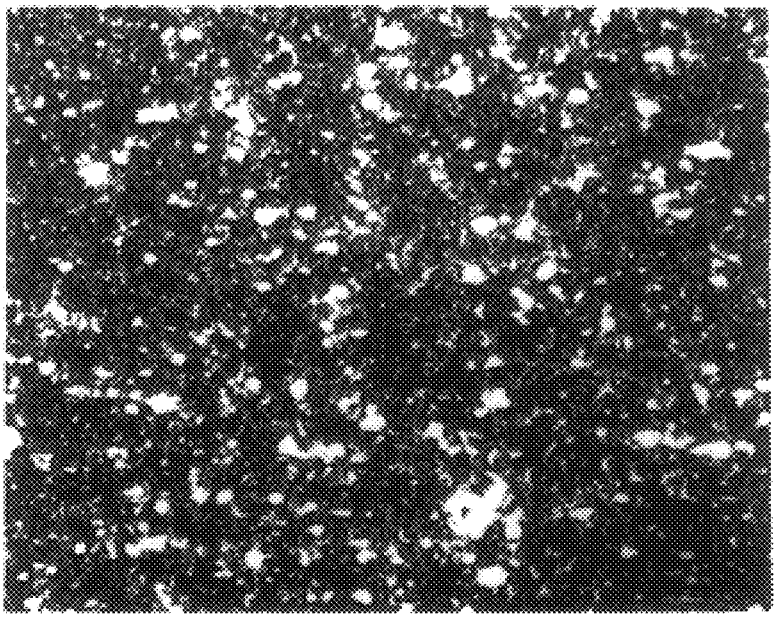
FIG. 7 is a microphotograph (magnification of 400 times) of the surface and the cross section of the nitriding layer of the Comparative Product B.
Figure 7:
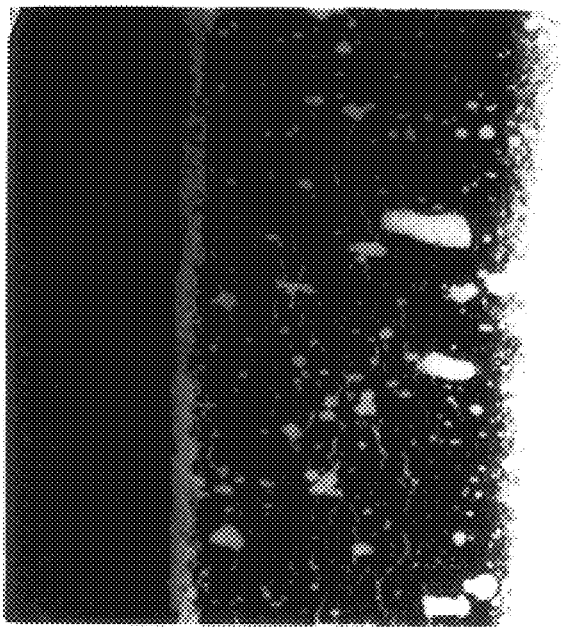

The cross-sectional microstructure of the nitriding layer is shown in FIG. 4 for Invention Product A, FIG. 5 for Invention Product B, FIG. 6 for Comparative Product A, and FIG. 7 for Comparative Product B. As shown in FIGS. 4 and 5, a number of compound layers are present in the grain boundaries, and the coarse carbo-nitride present in the crystal grains is 10 it m or less in size. In addition, as shown in Table 2, the area ratio of carbo-nitride not less than 1 $\mu$m and not more than 10 $\mu$m in size is 5% or less in Invention Products A and B.

Referring to FIG. 6, Comparative Product A satisfies the following requirement of the present invention: compound layer are present in the grain boundaries; no coarse precipitate is present, in the crystal grains; and the area ratio of the precipitates from 1 to 10 $\mu$m in size is 5% or less. However, since the Cr content of Comparative Product A is less than 5%, the matrix of the nitriding layer is of low strength and hence low fatigue strength. In Comparative Product B shown in FIG. 7, very large carbo-nitrides are present and the area ratio of the precipitates is 11.9%, greater than 5%. The fatigue strength is low possibly because of these reasons.

Test of Sliding Property (Test of Scuff Resistance)

Figure 8:
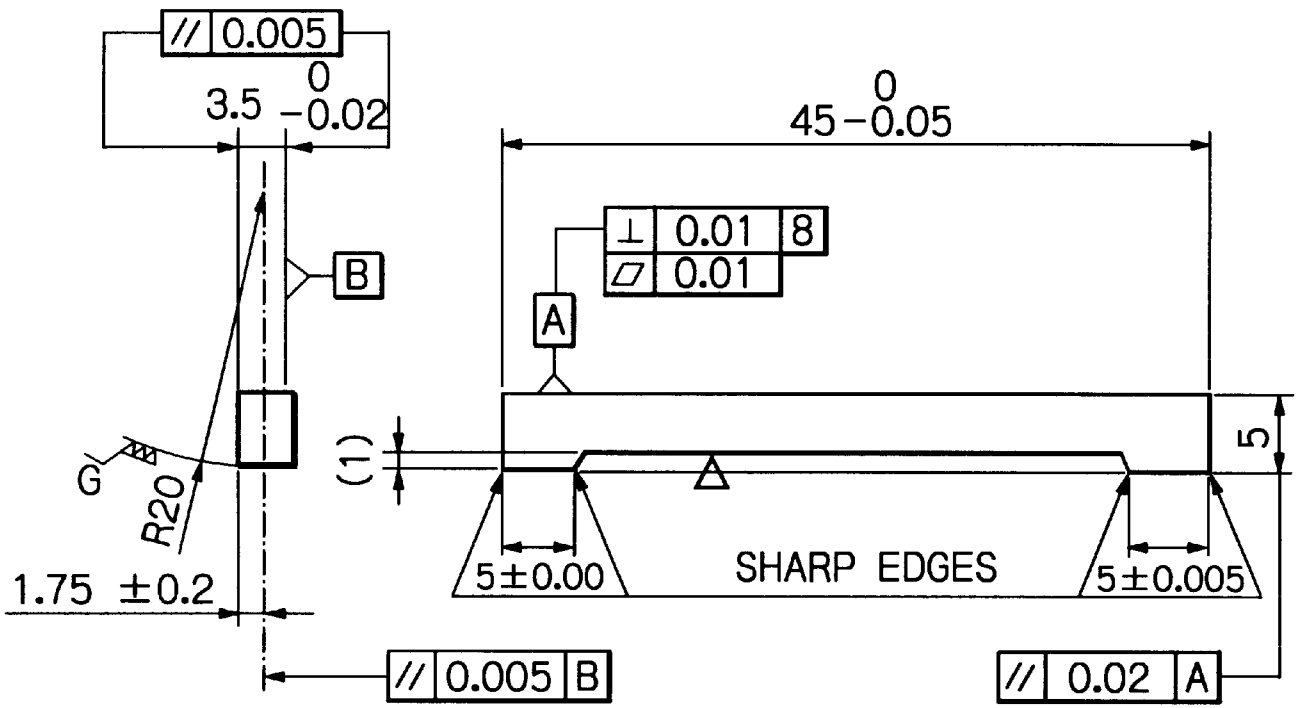
Fig. 8 PRIOR ART
FIG. 8 shows a scuff-test specimen.
Figure 9:
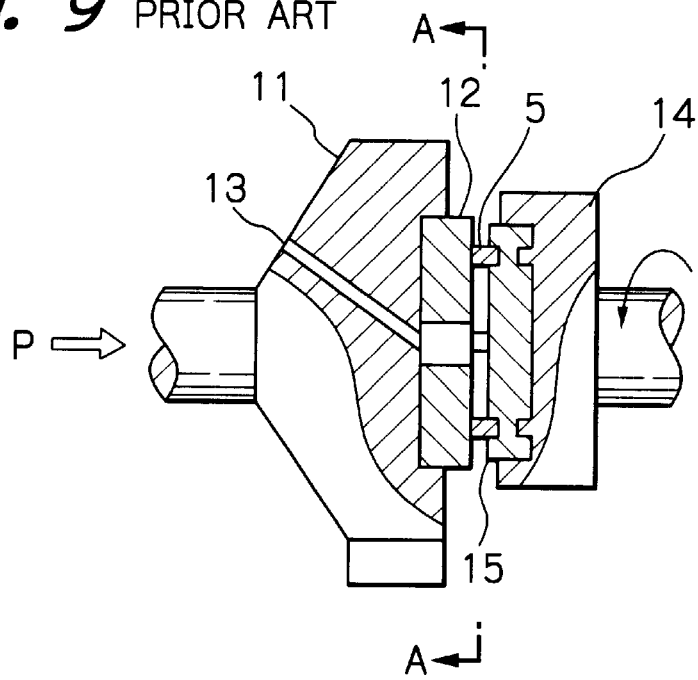
Fig. 9 PRIOR ART
FIG. 9 is a part of cross sectional view of an ultra-high pressure wear testing machine.
Figure 10:
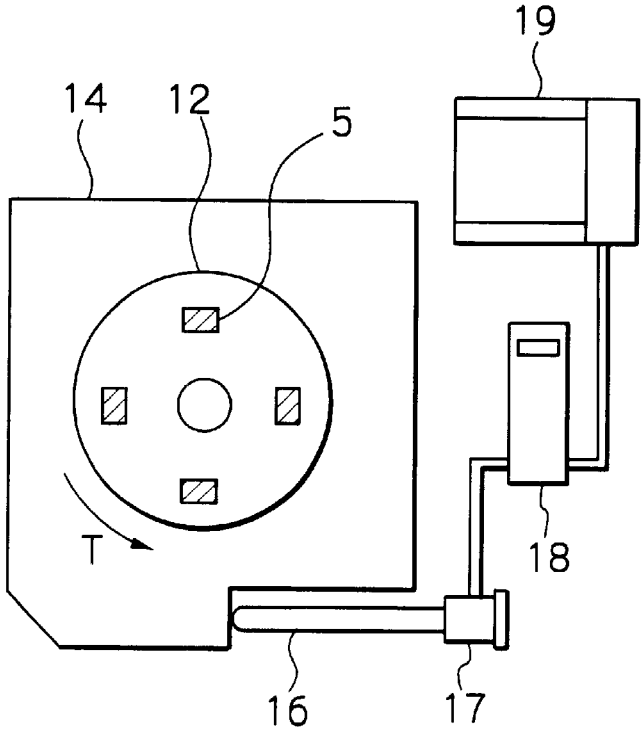
Fig. 10 PRIOR ART
FIG. 10 is a view seen in the line A-A' of FIG. 9.

Specimens for testing the scuff resistance as shown in FIG. 8 were prepared from Invention Products A and B and Comparative Products A and B. The specimens were appropriately pre-treated and then subjected to gas nitriding at 570° C. for 360 minutes. The surface compound layer (white layer) was then removed from the surface, and the sliding surface was finished to 20 mm R and roughness of Ra 0.4 $\mu$m or less. The scuff resistance of the so treated specimens is evaluated using a testing machine shown in FIGS. 9 and 10. In FIGS. 9 and 10, the reference numerals denote the following members: 16—torque-transmission shaft; 17—load cell, 18—amplifier; and 19—recorder. The contact load was increased stepwise and the time of abrupt increase of frictional force was determined. The contact load at this time was evaluated as the scuffing load. At the same time, contact area was measured by microscope. Scuffing load was defined by (scuffing load/contact area). The test conditions and results (Table 3) were as follows.

Testing Condition

Sliding Speed: 8 m/s

Contact Load: increase by 0.2 Pa each from 1.0 Pa

Lubricating Oil: motor oil #20

Oil Temperature: 80° C.

Amount of Oil: 5 cc/min

Opposite Material: FC250 equivalent (Surface roughness Rz 1–2 $\mu$m)

TABLE 3

| Specimens | Scuffing Load (MPa) |
|---|---|
| Invention Product A | 354 |
| Invention Product B | 353 |
| Comparative Material A | 352 |
| Comparative Material B | 360 |

The scuffing load of Invention Products A and B is comparable to that of Comparative Product A and B. These scuffing loads are satisfactory for the sliding members.

(Wear Resistance Test)

Figure 11:
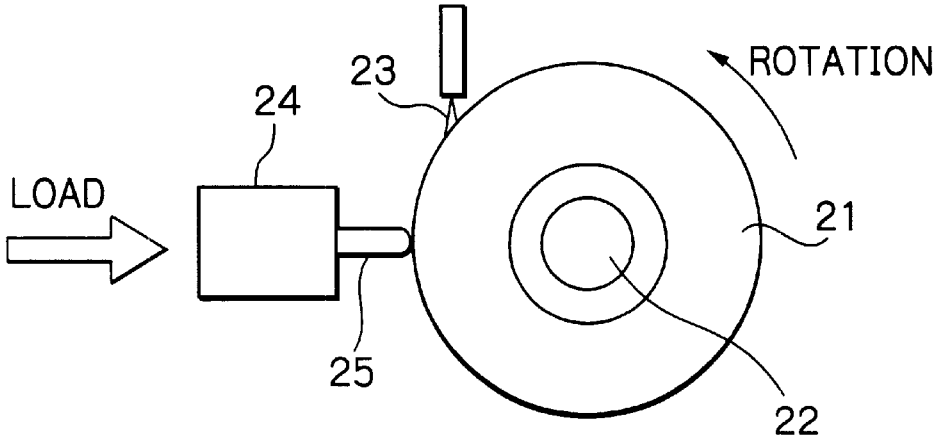
Fig. 11 PRIOR ART
FIG. 11 shows a part of another wear testing machine.

Wear test was carried out using a testing machine shown in FIG. 11. The specimens 25 were 5 mm×5 mm×20mm in size. The sliding surface was finished as the specimen for the scuff resistance test. That is, the nitriding, removal of a white layer, and finishing to a 20R of curved surface were carried out. In FIG. 11, the reference numerals denote the following members: 21—opposite material (FC250 equivalent); 22—electric heater; 23—lubricating oil; and 24—specimen-holder. The testing conditions were as follows.

Testing Machine: pin-drum wear testing machine

Friction Speed: 0.5 m/s

Time: 4 hours

Load: 490N

Surface Temperature of Drum: 180° C.

Lubrication: motor oil #30, 0.15 cc/min

TABLE 4

| Specimens | Wear Amount ($\mu$m) |
|---|---|
| Invention Product A | 4 |
| Invention Products B | 3 |
| Comparative Product A | 15 |
| Comparative Product B | 3 |

The wear resistance of Invention Products A and B is equivalent to that of Comparative Product B and is satisfactorily high.

As is described hereinabove, the steel for nitrding according to the present invention can exhibit simultaneously both high sliding property and fatigue-resistance and, it is therefore, extremely useful for such parts as an automotive spring, a piston ring, and wear-resistant parts, for which both properties are required together.

What is claimed is:

1. Sliding member which consists of a steel consisting of from 0.5 to 1.0% of C, 1.0% or less of Si, from 0.3 to 1.0% of Mn, from 5.0 to 12.0% of Cr, from 0.5 to 2.0% of Mo, from 0.1 to 0.3% of V, the balance being Fe and unavoidable impurities, and a nitriding layer formed on at least the outer peripheral sliding surface of said steel, wherein said nitriding layer comprises crystal grains, compound layer precipitated along the boundaries of the crystal grains, and precipitates consisting essentially of carbonitrides dispersed within the crystal grains and having less than 10 $\mu$m in size, and further area percentage of the precipitates from 1 to 10 $\mu$m in size is 5% or less.

2. Sliding member according to claim 1, wherein the nitriding layer is subsequently not subjected to post-treatment.

3. Sliding member which consists of a steel consisting of from 0.5 to 1.0% of C, 1.0% or less of Si, from 0.3 to 1.0% of Mn, from 5.0 to 12.0% of Cr, from 0.5 to 2.0% of Mo, from 0.1 to 0.3% of V. the balance being Fe and unavoidable impurities, and a nitriding layer formed on at least the outer peripheral sliding surface of said steel, wherein said nitriding layer has a thickness of from 5 to 200 $\mu$m and comprises crystal grains, compound layer precipitated along the boundaries of the crystal grains, and precipitates consisting essentially of carbonitrides dispersed within the crystal grains and having less than 10 $\mu$m in size, and further area percentage of the precipitates from 1 to 10 $\mu$m in size is 5% or less.

4. Sliding member according to claim 3, wherein the nitriding layer is subsequently not subjected to post-treatment.

* * * * *